US007137842B2

(12) United States Patent
Ko

(10) Patent No.: US 7,137,842 B2
(45) Date of Patent: Nov. 21, 2006

(54) MICRO COAXIAL CABLE CONNECTOR HAVING UNIQUE INSULATIVE HOUSING

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/101,899

(22) Filed: Apr. 8, 2005

(65) Prior Publication Data

US 2006/0228929 A1 Oct. 12, 2006

(51) Int. Cl.
*H01R 13/627* (2006.01)

(52) U.S. Cl. ..... 439/358

(58) Field of Classification Search ..... 439/358, 439/352, 353, 354

See application file for complete search history.

(56) References Cited

U.S. PATENT DOCUMENTS 5,380,223 A * 1/1995 Marsh et al. ..... 439/610
D456,779 S 5/2002 Igarashi
6,619,985 B1 9/2003 Ko
D482,660 S 11/2003 Hisamatsu
6,648,668 B1 11/2003 Ko
6,659,791 B1 12/2003 Ko
D489,335 S 5/2004 Ko
6,786,755 B1 * 9/2004 Dambach et al. ..... 439/353
6,948,973 B1 * 9/2005 Hsu et al. ..... 439/495
2005/0020122 A1 * 1/2005 Takaku et al. ..... 439/357

* cited by examiner

*Primary Examiner*—Phuong Dinh
(74) *Attorney, Agent, or Firm*—Wei Te Chung

(57) ABSTRACT

An electrical connector (100) includes an insulative housing (1) having a pair of opposite traversal ends and a plurality of slots, a number of contacts (21) received in the slots of the insulative housing (1), at least a latch (4) having a main body, a hook extending forward therefrom and a resilient tab extending rearward therefrom pivotally assembled to the end of the housing (1). The latch (4) is partially located inside of the traversal end of the insulative housing (1).

20 Claims, 9 Drawing Sheets

MICRO COAXIAL CABLE CONNECTOR HAVING UNIQUE INSULATIVE HOUSING

CROSS REFERENCE TO RELATED APPLICATION

This application relates to application Ser. No. 10/895,877, filed on Jul. 20, 2004 and entitled "MICRO COAXIAL CABLE CONNECTOR ASSEMBLY AND METHOD OF ASSEMBLING THE SAME" and invented by the same inventor as this patent application and assigned to the same assignee with this application.

BACKGROUND OF THE INVENTION

1. Field of the Invention

The present invention relates generally to an electrical connector, and more particularly to a high speed connector.

2. Description of the Prior Art

U.S. Pat. No. 6,648,668 discloses a micro coaxial connector, which comprises an insulative housing having a pair of retention portions, a pair of latch devices having a pair of receiving cavities and spring tabs, a contact set and a shield. When each latch device assembles to the insulative housing, the receiving cavity receives the retention portion of the housing and the spring tab is exposed to outside. The exposed spring tab may be damaged so as to make the latch unuseful. Additionally, the prior art connector does not have a header in the insulative housing, therefore, mating the micro coaxial connector with a complementary connector by pushing the insulative housing may not be easy.

Hence, a micro coaxial connector is needed to overcome the problems encountered in the related art.

BRIEF SUMMARY OF THE INVENTION

It is an object of the present invention to provide a micro coaxial cable connector having a unique insulative housing, which protects the latches from being damaged and can be pushed easily when mate the connector with a complementary connector.

In order to achieve the object set forth, An electrical connector comprising an insulative housing, which has a pair of opposite traversal ends and a plurality of slots, a plurality of contacts received in the slots of the insulative housing, at least a latch having a main body, a hook extending forward therefrom and a resilient tab extending rearward therefrom pivotally assembled to the traversal end of the housing. The latch is partially located inside of the traversal end of the insulative housing.

Additional novel features and advantages of the present invention will become apparent by reference to the following detailed description when taken in conjunction with the accompanying drawings.

DETAILED DESCRIPTION OF THE INVENTION

Reference will now be made in detail to a preferred embodiment of the present invention.

Figure 1:
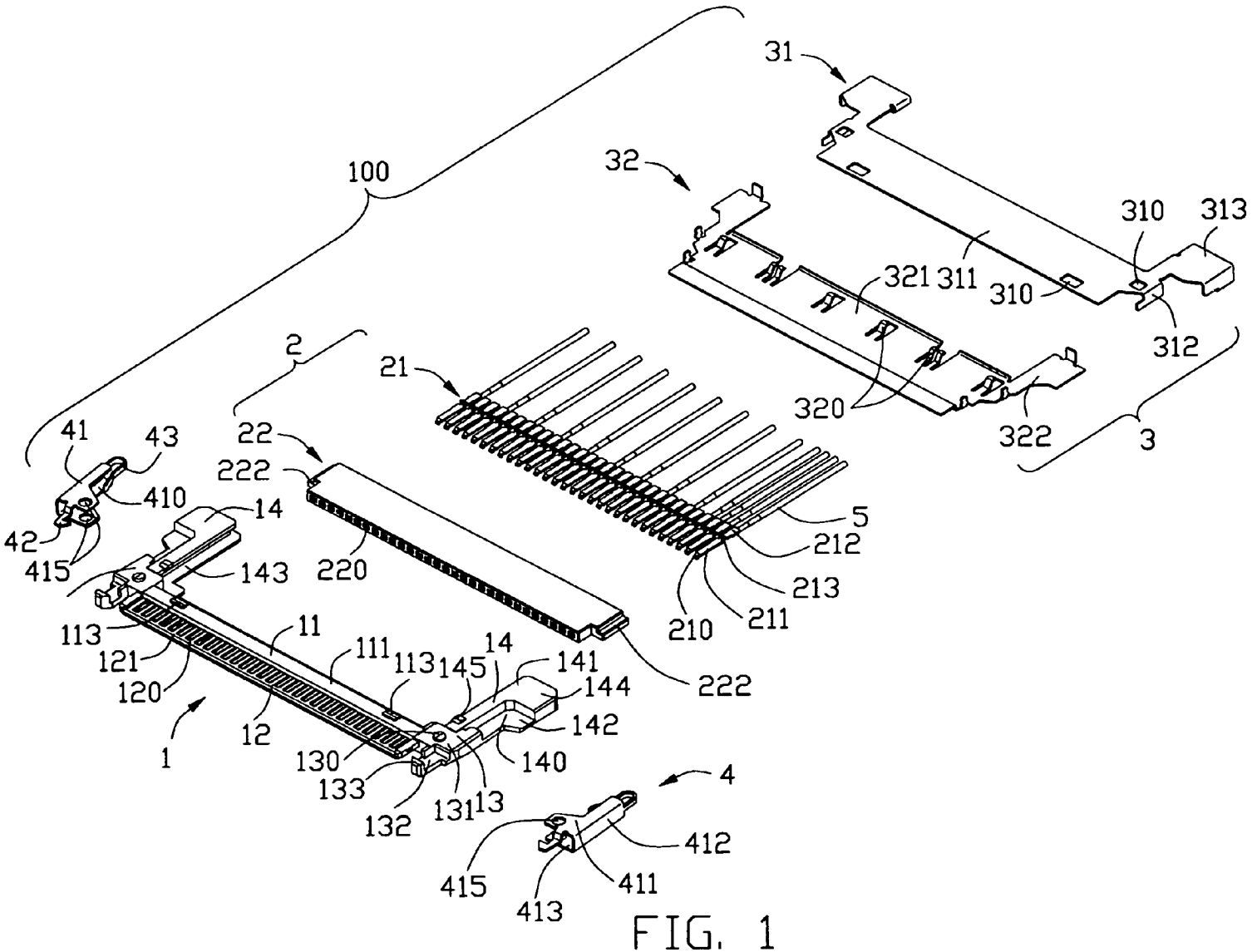
FIG. 1 is an exploded, perspective view of an electrical connector in accordance with the present invention.
Figure 2:
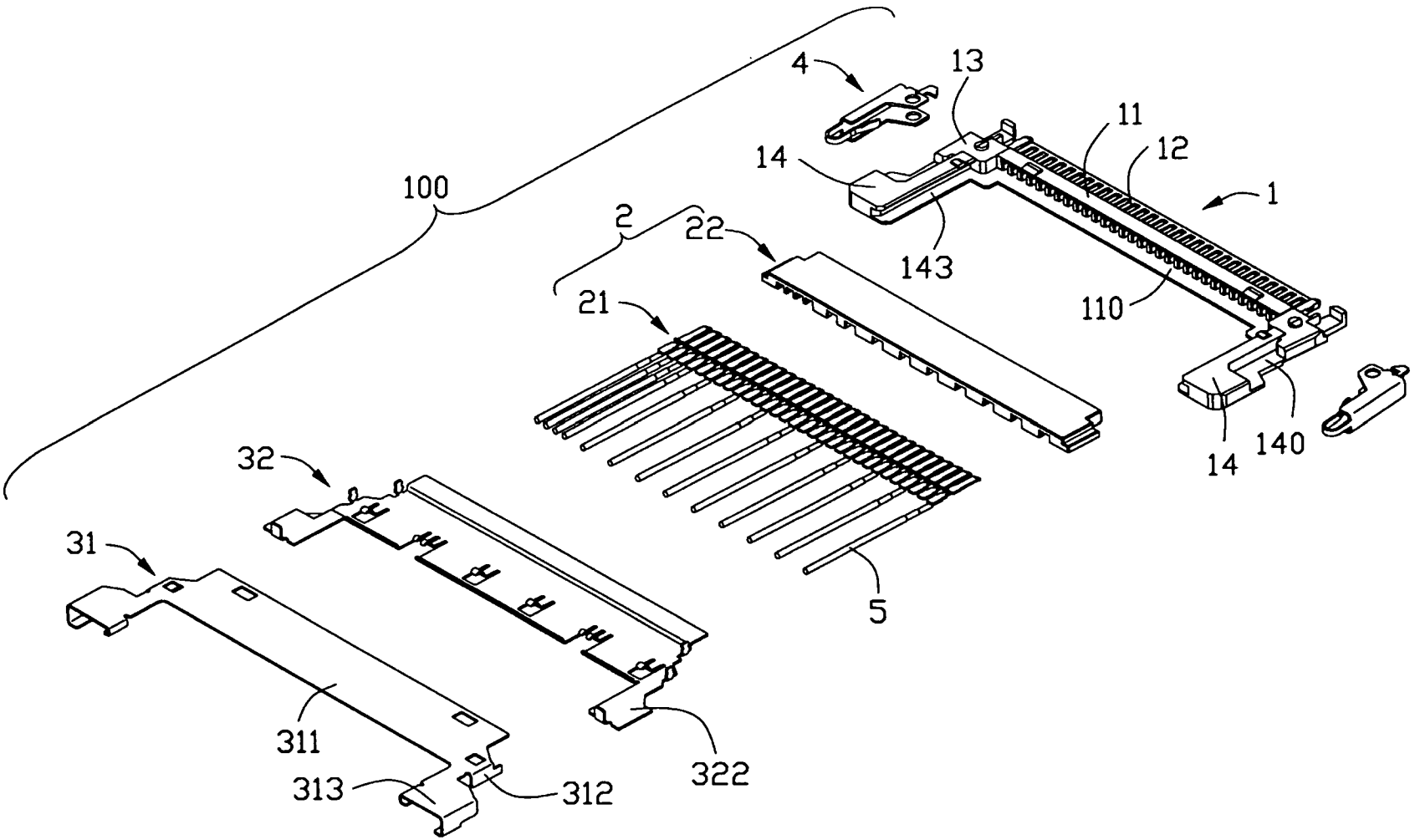
FIG. 2 is a view similar to FIG. 1, but taken from a different aspect.
Figure 3:
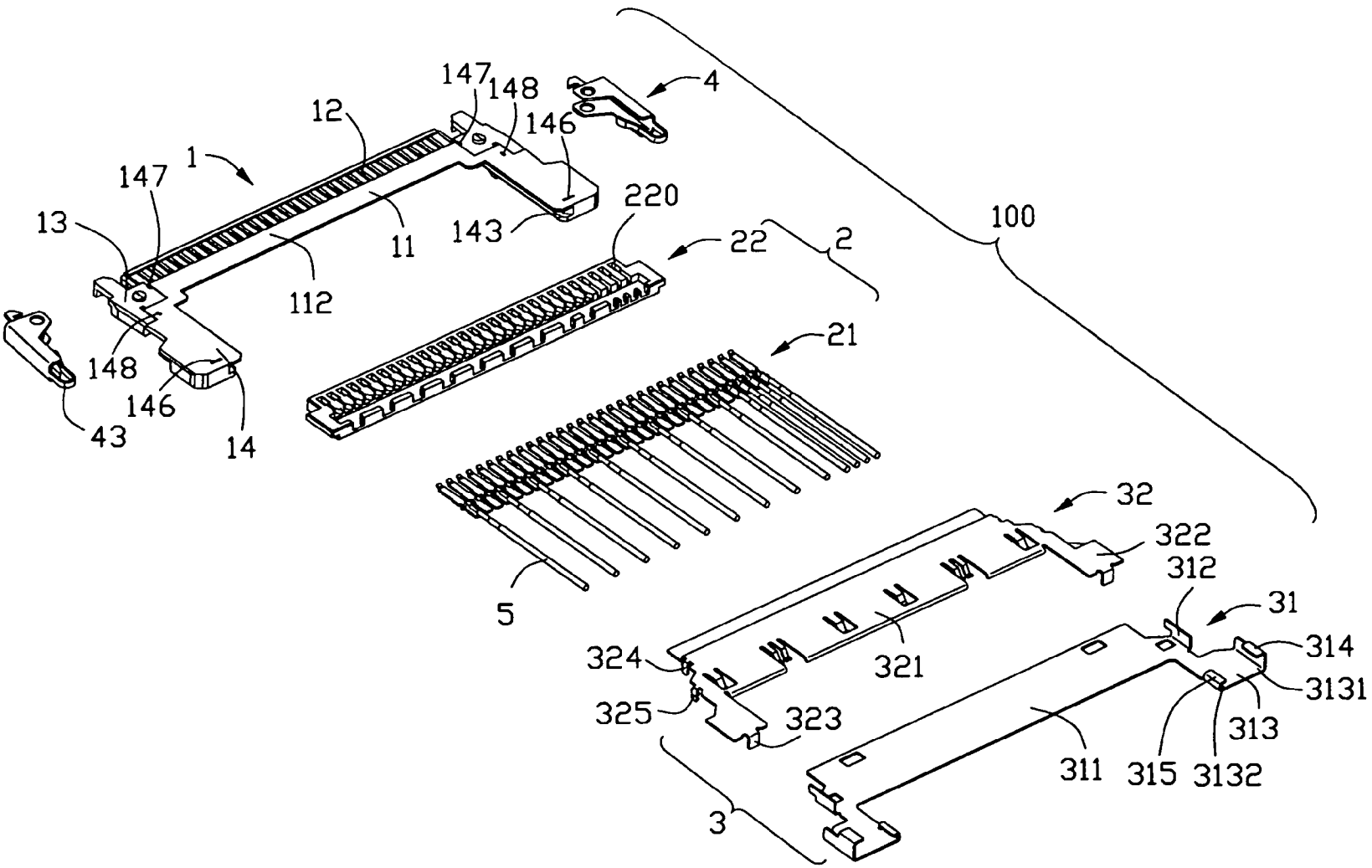
FIG. 3 is a view similar to FIG. 1, but taken from another different aspect.

Referring to FIGS. 1 to 3, a connector assembly 100 according to the present invention comprises a micro coaxial cable connector and a plurality of cables 5 coupling to the micro coaxial cable connector. The micro coaxial cable connector comprises an insulative housing 1, a contact set 2, a shell 3 and a pair of latches 4.

Figure 6:
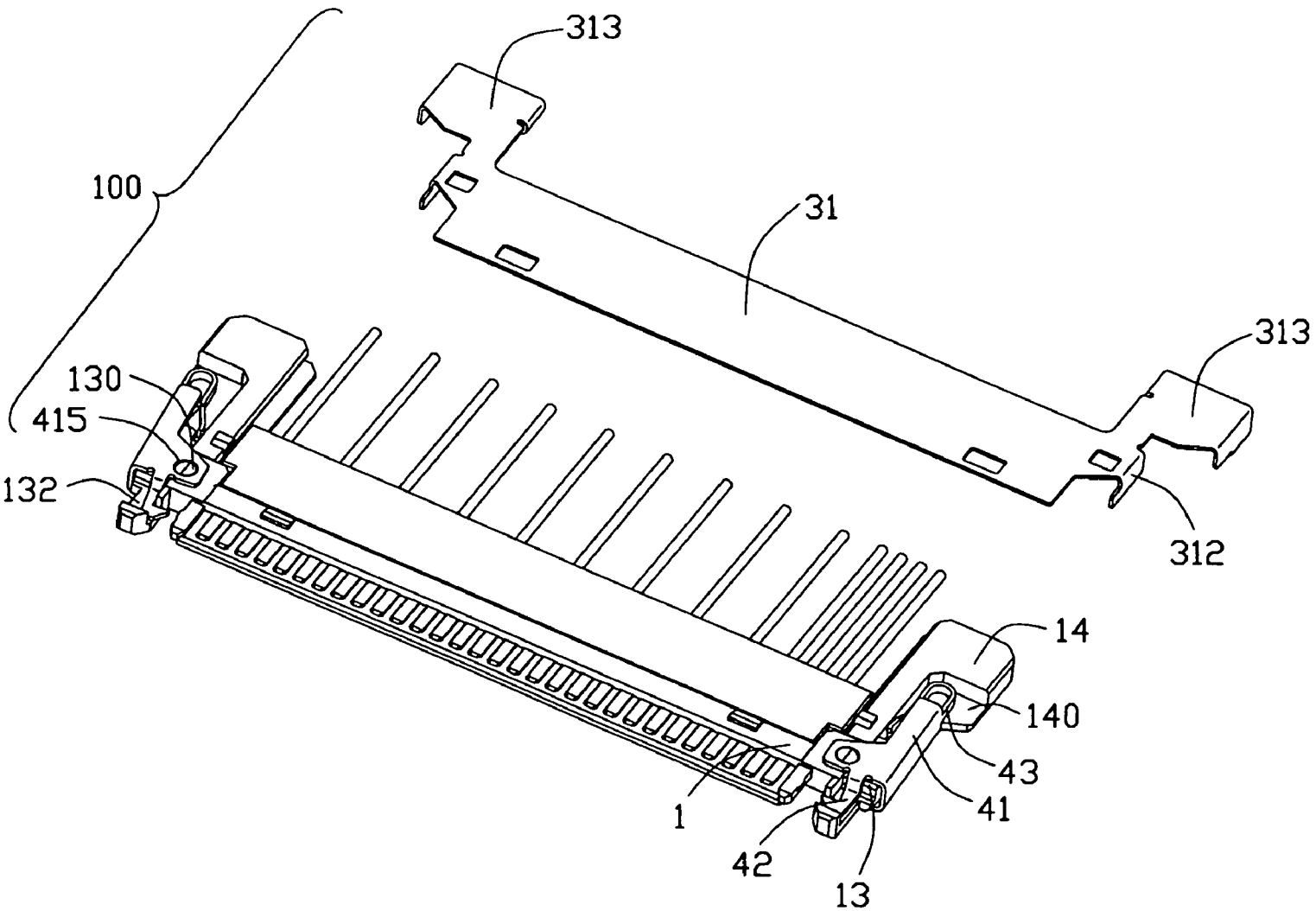
FIG. 6 is a partially assembled view of the electrical connector of FIG.
Figure 7:
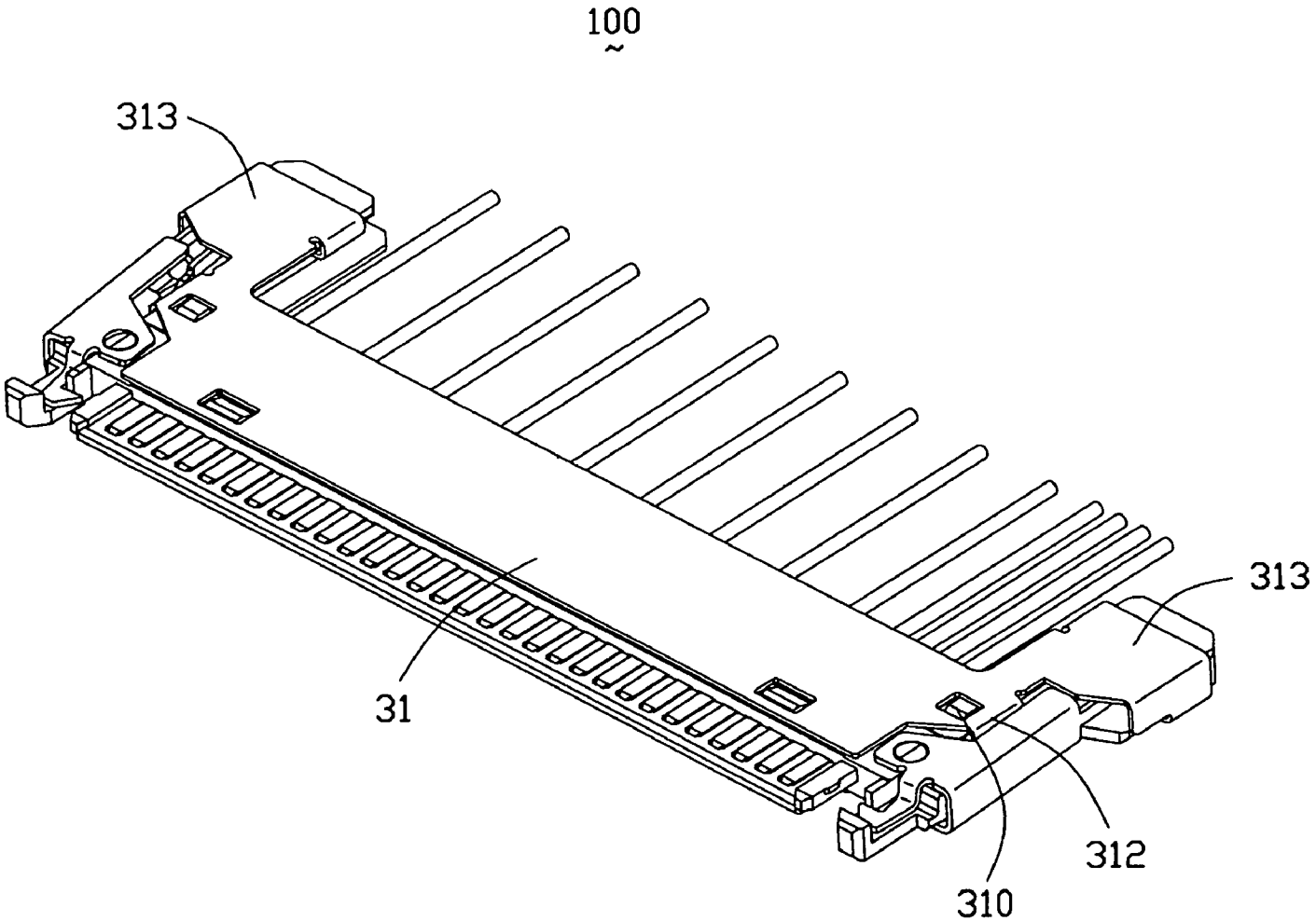
FIG. 7 is an assembled view of the electrical connector of FIG. 1.
Figure 8:
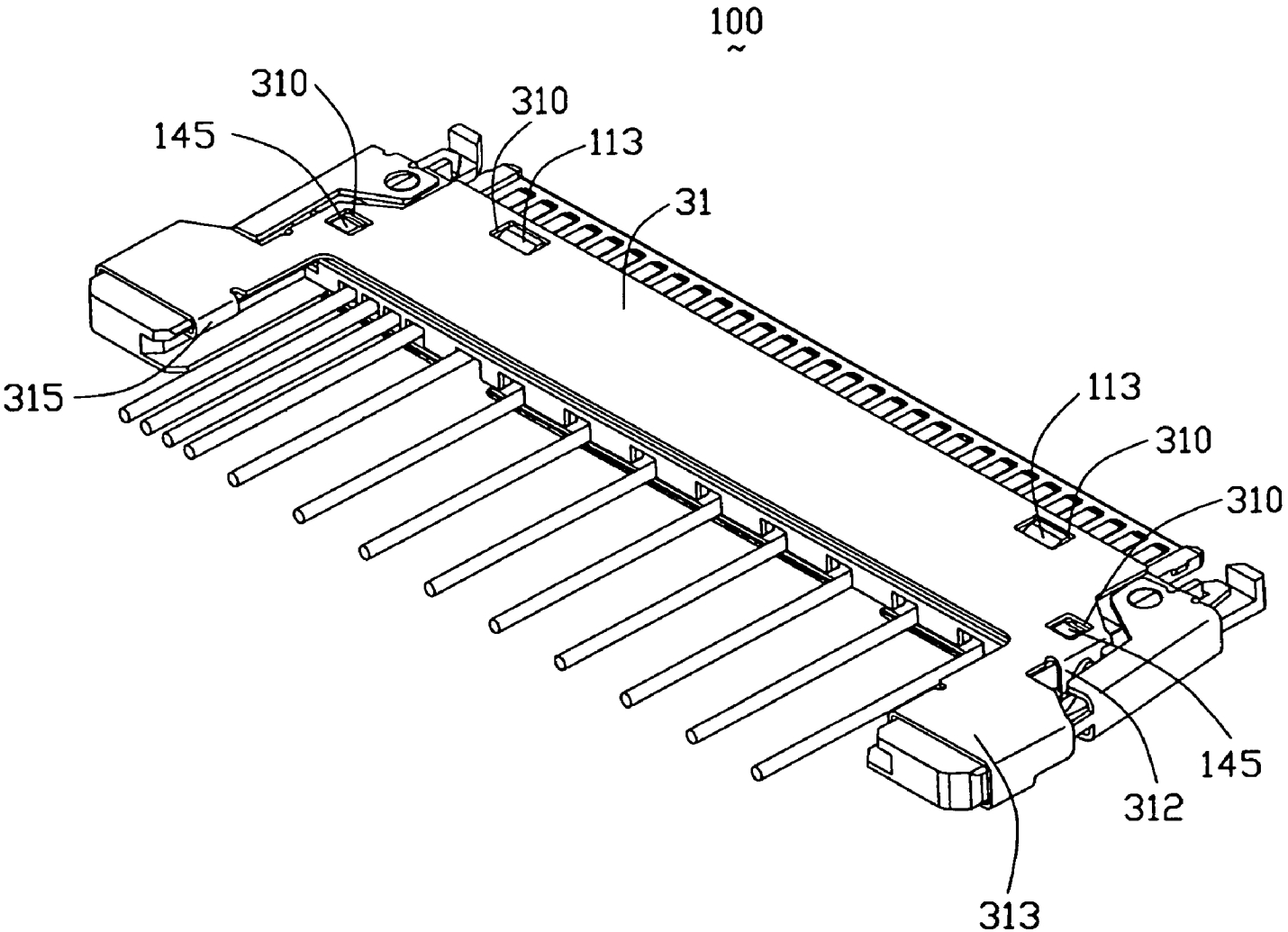
FIG. 8 is an assembled view of the electrical connector of FIG. 2.

The insulative housing 1 comprises a base portion 11, a mating portion 12 extending forwardly from the base portion 11, a pair of retention portions 13 formed on opposite transverse ends of the base portion 11 and a pair of stretch portions 14 extending rearward from the respective retention portion 13. The base portion 11 has a top wall 111 and a bottom wall 112 and defines a plurality of passageways 110 therethrough. A pair of protruding pieces 113 are formed on the top wall 111 of the base portion 11. The mating portion 12 defines a plurality of slots 120 and each slot 120 communicates with a corresponding passageway 110 and has a close end 121 therefront. The retention portion 13 comprises a body portion 131, a guiding plate 132 extending forwardly from the body portion 131 and having an upright tip 133 positioned perpendicularly at front end thereof for facilitating a mating of a complementary connector (not shown). A pair of retention posts 130 are formed on upper and lower surfaces of each retention portion 13 for facilitating mounting of the latches 4. Each stretch portion 14 having an upper wall 141 and a lower wall 142 defines a recess area 140 recessed inwardly from an outer side thereof and a receiving channel 143 recessed outwardly from an inner side thereof. The recess area 140 is used to receive a resilient tab 43 of the latch 4 (shown in FIG. 6) so as to prevent the latch 4 from being damaged effectively. The recess area 140 is shaped like the letter "J" and located in the front of the stretch portion 14. A rectangular header 144 is formed in the rear of the stretch portion 14 for mating the connector with a complementary connector by being pushed facilely. A protrusion 145 is located on the upper wall 141 for engaging with the shield 3. There are provided three pairs of cuts 146, 147, 148 at the insulative housing 1 for engagement with the shell 3.

The contact set 2 comprises a plurality of contacts 21 and an insulative insert 22. The contacts 21 have the same structure and each comprises a mating area 211, a mounting area 212 and a connecting area 213 coupling the mating area 211 to the mounting area 212. The mating area 211 has a fastening tip 210 downwardly curved from a front end thereof for securely fastening with the insulative housing 1. The mounting area 212 connects to the cable 5. The insulative insert 22 comprises a plurality of receiving grooves 220 for receiving mounting areas 212 and engaging with connecting area 213 of the contacts 21 and openings 221 for allowing the cable 5 to extend into the grooves 220 (showing in FIG. 4). There are positioned a pair of laddered portions 222, which will guild the insulative insert 22 into the insulative housing 1 perfectly, at lateral edges of the insulative insert 22. When the insulative insert 22 enters into the insulative housing 1, the laddered portions 222 will be inserted into the receiving channel 143.

Figure 9:
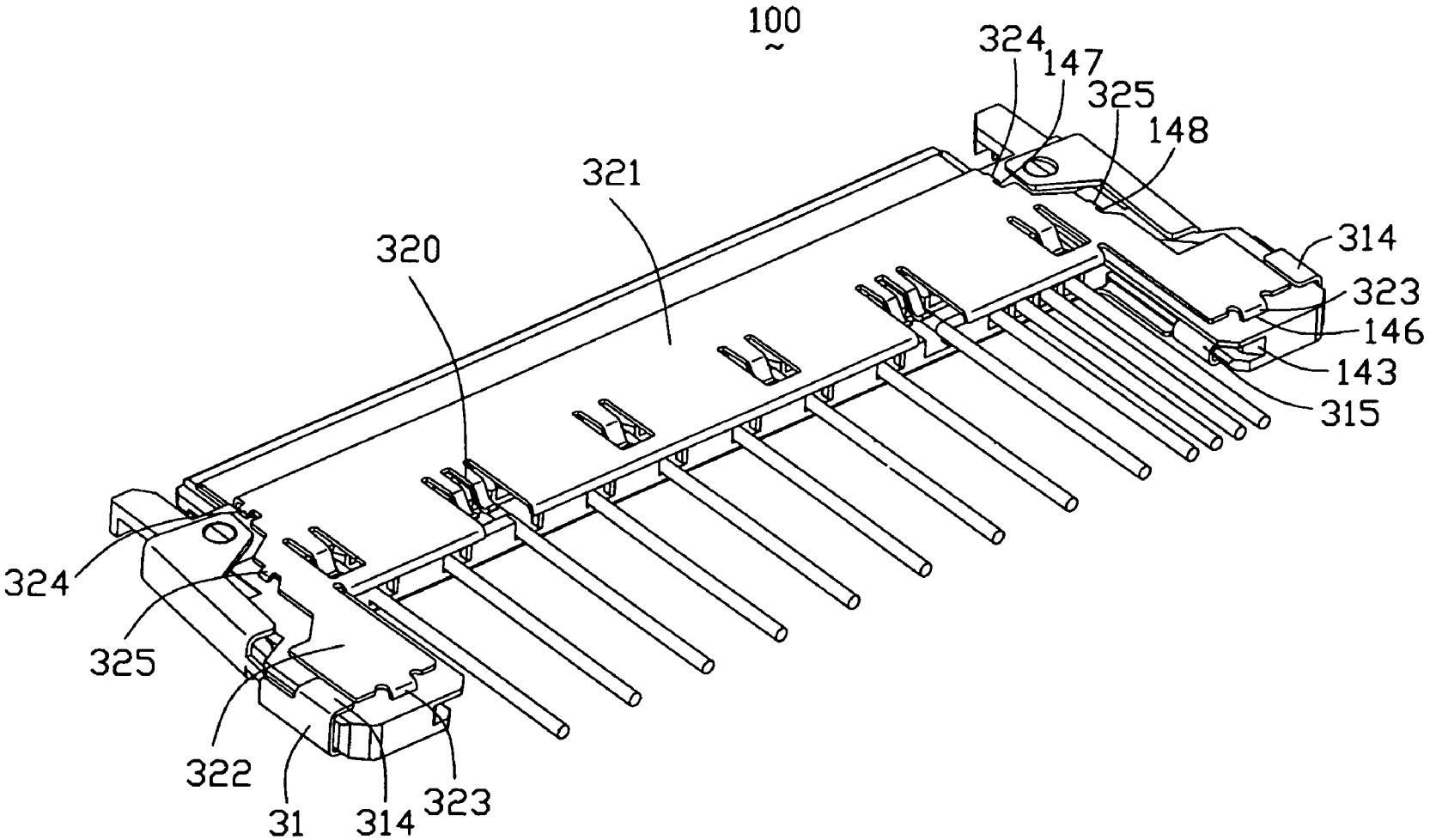
FIG. 9 is an assembled view of the electrical connector of FIG. 3.

The shell 3 comprises a top plate 31 and a bottom plate 32. The top plate 31 has a first base plate 311 and a pair of lower flanges 312 positioned at opposite lateral edges of the base plate 311 and a pair of enlarged first holding bars 313 extending rearward and laterally from the base plate 311. Each holding bar 313 has opposite end edges 3131, 3132 and first and second engaging portions 314, 315 extending inwardly thereof for engagement with the insulative housing 1 (as shown in FIG. 9). In order to adapt to the insulative housing 1, the height of the first engaging portion 314 is much higher than that of the second engaging portion 315. Two pairs of notches 310 are spaced arranged in the top plate 31. The bottom plate 32 has a second base plate 321 and a pair of enlarged second holding bars 322 extending rearward and laterally from the base plate 311. An engaged tab 323 extends from a rear end of each holding bar 322 and two pairs of meshed tabs 324, 325 extends perpendicularly from each lateral edges of the base plate 321. A plurality of spring tabs 320 are formed at middle region of the second base plate 321.

Each latch 4 comprises a main body 41 defined as U shape by a top portion 411, a bottom portion 413 and a side portion 412, a hook 42 extending downwardly and forwardly from a top portion 411 and a resilient tab 43 extending forwardly from a rear edge of the side portion 412 and in a direction away from an inner surface of the side portion 412. The top portion 411, bottom portion 412 and side portion 413 together define a receiving space 410. A pair of retaining holes 415 are defined through the top portion 411 to bottom portion 412 of the body portion 41.

Figure 4:
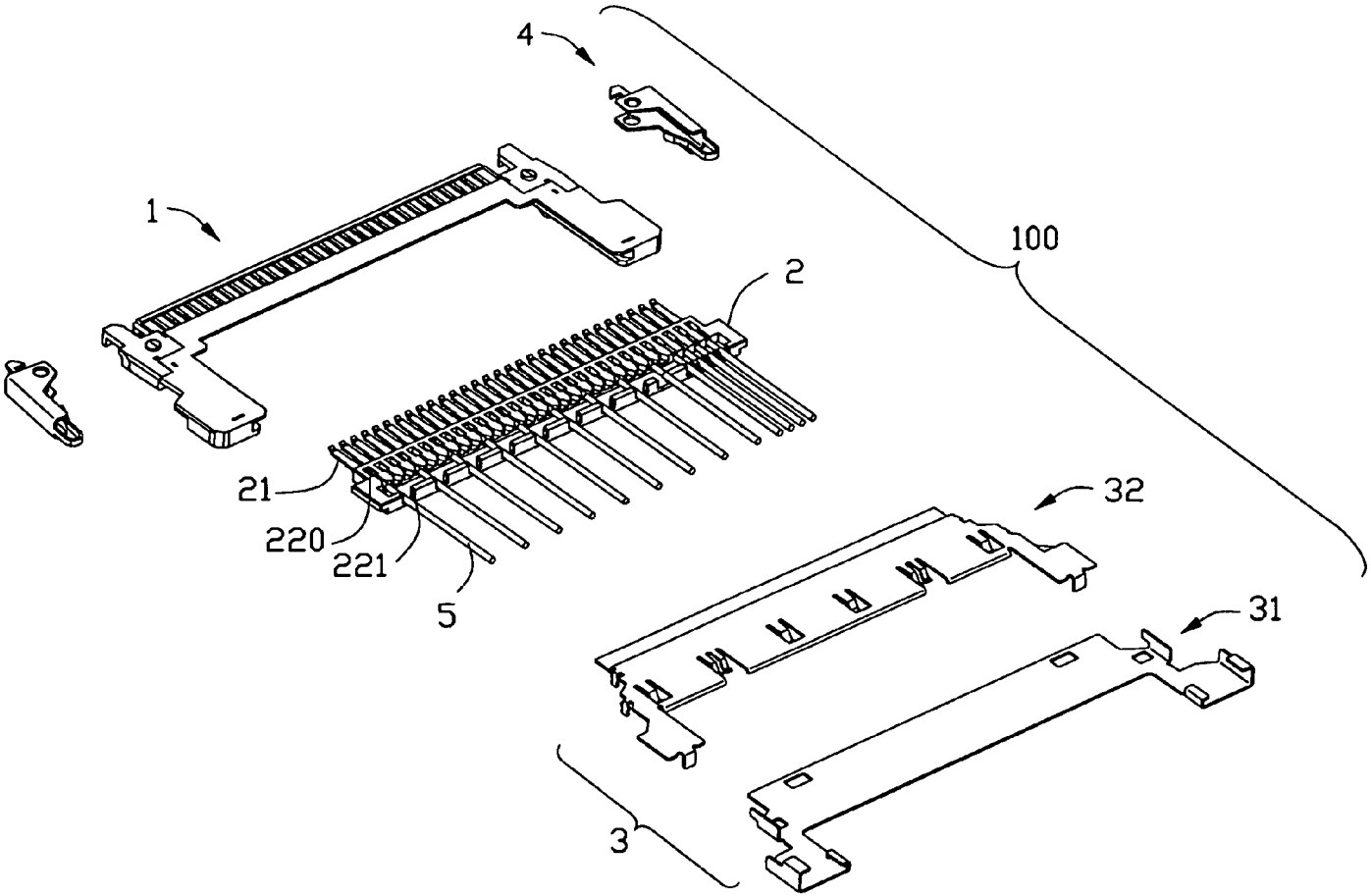
FIG. 4 is a partially assembled view of the electrical connector of FIG. 3.
Figure 5:
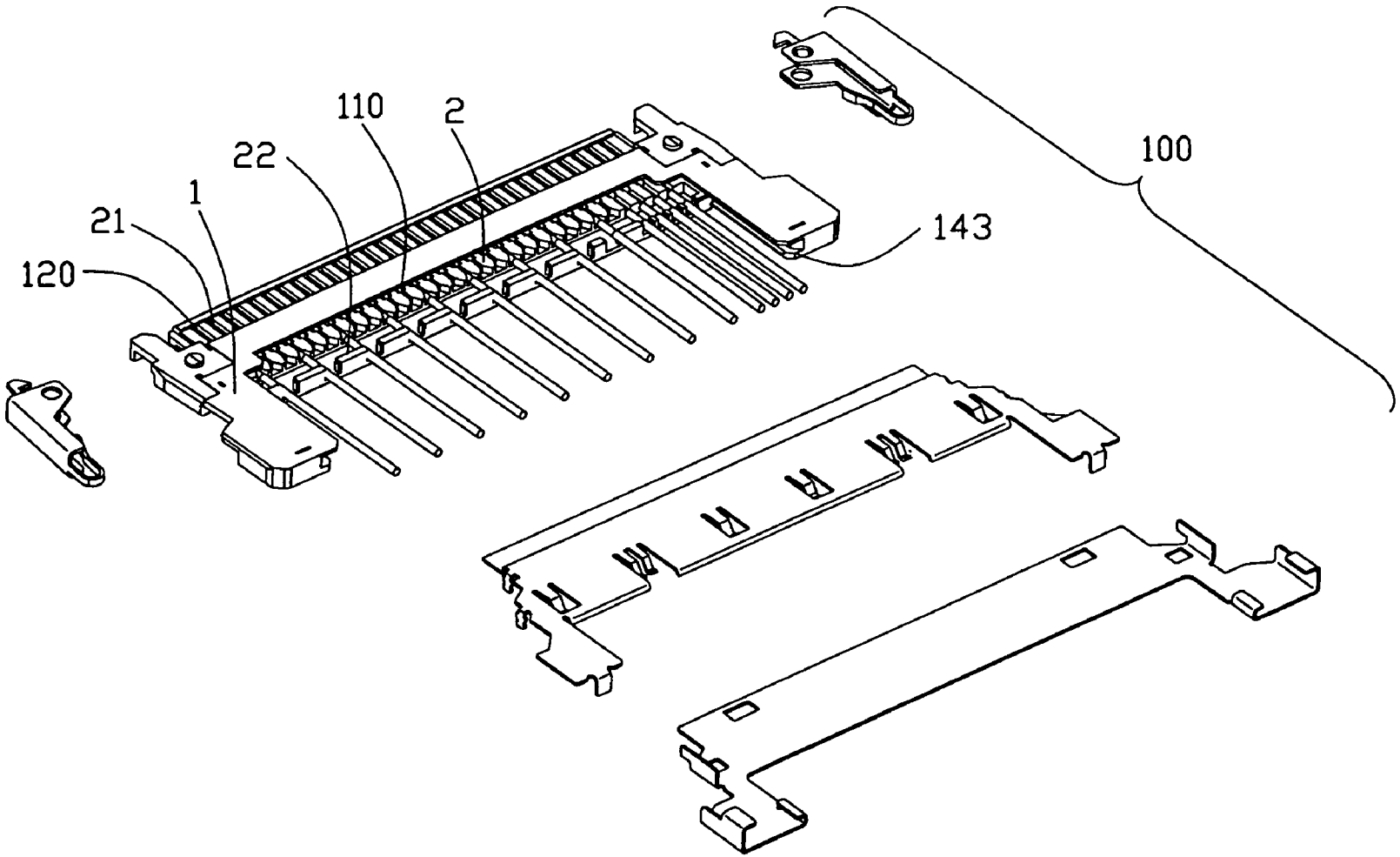
FIG. 5 is a partially assembled view of FIG. 4.

Referring to FIG. 4, in assembly, the contacts 21 and the cables 5 are respectively inserted into the receiving grooves 220 and the openings 221 of the insulative insert 22. Referring to FIG. 5, the contact set 2 is assembled to the insulative housing 1 with the laddered portions 222 of the insulative insert 22 sliding along the receiving channels 143 and then received in the receiving channels 143 and the mating areas 211 of the contacts 21 extending into the passageways 110 and slots 120, respectively. Each fastening tip 210 (FIG. 1) of each contact 21 is partially emplaced in the close end 121 (FIG. 1). Referring to FIGS. 6 to 9, each latch 4 is assembled to the insulative housing 1 with the main body 41 thereof enclosing corresponding retention portion 13 of the housing 1, the hook 42 abuts against an upper surface of the guiding plate 132 and the resilient tab 43 received in the recess area 140 of the stretch portion 14. Each retention post 130 is fitted into the respective retaining hole 415 of the latch 4 in a pivotal way. The shield 3 is assembled to the insulative housing 1 with the top plate 31 and the bottom plate 32 placed on the top wall 111 and the bottom wall 112 of the base portion 11, respectively. The two pairs of notches 310 of the top plate 31 mate with the corresponding protruding pieces 113 of the base portion 11 and the protrusions 145 of the stretch portion 14, respectively so as to fix the top plate 31 to the insulative housing 1 securely. Each lower flange 312 of the top plate 31 extends downwardly into the recess area 140 along a side direction of the upper wall 141 of the stretch portion 14. The first engaging portion 314 of the top plate 31 extends along the outer sidewall of the header 144 and grasp the header 144 as well as the second engaging portion 315 of the top plate 31 projects inwardly into the receiving channel 143 and grasp the header 144 so that the top plate 31 of the shell 3 is installed at the insulative housing 1 reliably. The engaged tab 323 and meshed tabs 324, 325 of the bottom plate 32 are inserted into the respective cut 146, 147, 148, therefore, the bottom plate 32 of the shell 3 is fixed to the insulative housing 1 securely. The spring tabs 320 of the bottom plate 32 press against the insulative insert 22 for fastness. The first and second holding bars 313, 322 of the shell 3 cooperate to partially enclose each header 144.

When the micro coaxial cable connector assembly 100 engages with the complementary connector, push the header 144 of the cable connector toward the complementary connector so that the hook 42 are extended into the complementary connector to latch therewith, whereby the connector and the complementary connector are securely connected together. To separate the connector from the complementary connector, rear ends of the latch devices 4 are pushed towards each other to cause the hook 42 to be pivoted away from each other, whereby the latch of the connector with the complementary connector is released and the connector can be pulled to separate from the complementary connector.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electrical connector comprising:

an insulative housing having a pair of opposite traversal ends and a plurality of slots;

a plurality of contacts received in the slots of the insulative housing;

at least a latch having a main body, a hook extending forward therefrom and a resilient tab extending rearward therefrom, the latch pivotally assembled to the traversal end of the housing;

wherein the latch is partially located inside of the traversal end of the insulative housing, and the main body of the latch is defined as "U" shaped partially wrapping the traversal end of the insulative housing.

2. The electrical connector as claimed in claim 1, wherein the traversal ends have at least a recess area and the latch has a resilient tab, and wherein the resilient tab is received in the recess area.

3. The electrical connector as claimed in claim 2, wherein the recess area is configured as a J-shape.

4. The electrical connector as claimed in claim 2, wherein the traversal ends have at least a stretch portion and the recess area is formed in the stretch portion.

5. The electrical connector as claimed in claim 4, wherein the stretch portion comprises a header for mating the electrical connector with a complementary connector by pushing facilely.

6. The electrical connector as claimed in claim 2, wherein the traversal ends have at least a retention portion for assembling the latch to the insulative housing.

7. The electrical connector as claimed in claim 6, wherein the insulative housing further has a base portion and a mating portion extending from the base portion, and wherein the retention portion is positioned at the lateral end edge of the base portion.

8. The electrical connector as claimed in claim 2, wherein the electrical connector farther comprises an insulative insert, and wherein the contacts are partially received in the insulative housing.

9. The electrical connector as claimed in claim 2, wherein each contact has a mating area and a fastening tip and the slots have a close end, and wherein each contact is received in the corresponding slot with the fastening tip partially emplaced in the close end.

10. The electrical connector as claimed in claim 2, wherein the electrical connector has a shell comprising a top plate and a bottom plate, and both plates together enclose the insulative housing.

11. The electrical connector as claimed in claim 10, wherein the top plate has a pair of first holding bars and the bottom plate has a pair of second holding bars, and both of the holding bars enclose the header of the stretch portion.

12. The electrical connector as claimed in claim 11, wherein the top plate further has a pair of lower flanges extending downwardly into each recess area.

13. The electrical connector as claimed in claim 12, wherein the insulative housing has a pair of cuts thereend and the lower plate comprises a pair of engaged tabs received in the cuts.

14. The electrical connector as claimed in claim 13, wherein the cuts are notched at a pair of headers of the insulative housing, respectively and the engaged tabs are inserted into the cuts.

15. An electrical connector comprising;

an insulative housing having a mating portion with a pair of opposite traversal end sections by two sides of the mating portion along a transverse direction; and a plurality of contacts received in the mating portion of the insulative housing;

at least a latch pivotally mounted to the transverse end portion, said latch having a main body, a hook located in front of the main body, and a urging device inwardly pushing the hook toward the mating portion;

wherein a recess is formed in said transverse end portion in communication with an exterior in both the transverse direction and a vertical direction, which is perpendicular to said transverse direction and mating direction of the mating portion, to protectively receive said urging device therein; and the main body of the latch is defined as "U" shaped partially wrapping the traversal end portion of the insulative housing.

16. The electrical connector as claimed in claim 15, wherein a metallic shield covers the housing and includes an end section covering a portion of said transverse end portion in said transverse direction so as to protect said urging device in said transverse direction.

17. The electrical connector as claimed in claim 16, wherein said latch is made of metal so as to have the urging device mechanically and electrically engaged with the end section when the latch is in a relaxed manner.

18. The electrical connector as claimed in claim 16, wherein the end section of said shield covers a portion of the recess in said vertical direction.

19. The electrical connector as claimed in claim 16, wherein another recess is formed in the transverse end portion in front of said recess to receive said hook, and said another recess communicates with the exterior in both said transverse direction and said vertical direction.

20. The electrical connector as claimed in claim 19, wherein said shield does not cover said another recess in at least one of said transverse direction and said vertical direction.

* * * * *